US006059050A

United States Patent [19]

Gray

[11] Patent Number: 6,059,050

[45] Date of Patent: May 9, 2000

[54] APPARATUS FOR CONTROLLING RELATIVE ROTATION OF A DRILLING TOOL IN A WELL BORE

[75] Inventor: Benjamin Gray, Silver Valley, Canada

[73] Assignee: Sidekick Tools Inc., Silver Valley, Canada

[21] Appl. No.: 09/005,596

[22] Filed: Jan. 9, 1998

[51] Int. Cl.[7] ..... E21B 7/04

[52] U.S. Cl. ..... 175/73; 188/180

[58] Field of Search ..... 175/61, 73, 320, 175/324; 188/71.5, 293, 180, 181

[56] References Cited

U.S. PATENT DOCUMENTS

| | | | |
|---|---|---|---|
| 3,804,183 | 4/1974 | Duncan et al. | 175/5 |
| 3,888,319 | 6/1975 | Bourne, Jr. et al. | 175/76 |
| 3,951,240 | 4/1976 | Dowell et al. | 188/71.5 |
| 4,199,033 | 4/1980 | Van Gundy, Jr. | 173/27 |
| 4,627,519 | 12/1986 | Larsen et al. | 188/1.11 |
| 4,805,744 | 2/1989 | Pringle | 188/71.5 |
| 5,020,609 | 6/1991 | Jeter | 175/48 |
| 5,186,264 | 2/1993 | Du Chaffaut | 175/27 |
| 5,215,151 | 6/1993 | Smith et al. | 175/45 |
| 5,220,963 | 6/1993 | Patton | 175/24 |
| 5,265,687 | 11/1993 | Gray | 175/62 |
| 5,311,952 | 5/1994 | Eddison et al. | 175/61 |
| 5,358,036 | 10/1994 | Mills | 166/68.5 |
| 5,370,450 | 12/1994 | Volz et al. | 303/119.2 |
| 5,474,142 | 12/1995 | Bowden | 175/27 |
| 5,485,889 | 1/1996 | Gray | 175/61 |
| 5,664,891 | 9/1997 | Kutinsky et al. | 384/420 |
| 5,888,165 | 3/1999 | Besler et al. | 475/204 |

*Primary Examiner*—Eileen Dunn Lillis
*Assistant Examiner*—Chong S. Cho
*Attorney, Agent, or Firm*—Adrian D. Battison; Murray E. Thrift

[57] ABSTRACT

An apparatus for controlling rotation of an outer sleeve member relative to an inner cylindrical duct member is used in a drilling system for controlling steering of a downhole drilling tool. The apparatus includes an annular swash plate pump and a stack of annular brake disks in the space between the members. The pump is driven by the rotation to pump fluid into a supply cylinder driving the brake. An orifice controls escape of the fluid from the chamber at a controlled rate. The rate is controlled to maintain a balance between the pumping rate and the brake pressure to keep the rotation at a required rate. The apparatus is used in the drilling system which includes a shallow bend in the drilling tool and a system for rotating the bent drilling tool slowly about a longitudinal axis of the drilling tool while the drill bit rotates more rapidly. The controlled orifice further allows the slow rotation to be halted at a predetermined orientation of the bend axis so as to effect a change in drilling direction.

21 Claims, 3 Drawing Sheets

APPARATUS FOR CONTROLLING RELATIVE ROTATION OF A DRILLING TOOL IN A WELL BORE

This invention relates to an apparatus for controlling the relative rotation between two parts and is particularly but not exclusively designed for use in a downhole drilling system which uses the torque from the drill bit to drive rotation of a bent sub of the drill string at a controlled rate to maintain a straight direction of drilling and to steer the drilling direction as required.

BACKGROUND OF THE INVENTION

It is previously known that a substantially vertical well bore can be turned with a short radius curved section into an inclined or horizontal well bore by providing a drilling tool which includes a bend section defining a transverse bend axis between a forward drill bit support portion and a trailing motor portion. The bend section of the drilling tool tends to steer the well bore so that it turns to a direction at right angles to a plane containing the bend axis. One particular example of this technique is disclosed in my U.S. Pat. No. 5,265,687. In this patent I also proposed that the bore be continued in a horizontal direction after the curved section is complete by adding shims to the underside of the drilling tool.

A method is disclosed in U.S. Pat. No. 5,215,151 (Smith et al) in which the drilling of a bore hole is effected using continuous coiled tubing which extends from a trailing end on a supply reel at the earth's surface to a leading end within the well bore.

The drilling of well bores using continuous coiled tubing is known conventionally and includes the supply of a drilling fluid which is pumped into the trailing end of the coiled tubing for transmitting the drilling fluid to the leading end of the tubing at the base of the well bore. At the base is provided a drilling tool which includes a drill bit rotatable relative to the drilling tool, the drill bit being driven by a motor usually powered by the flow of the drilling fluid through the drilling tool.

It is also previously known that, when drilling a horizontal bore section, the horizontal direction can be better maintained by slowly rotating the drilling tool with the bend section so that the bend section rotates about the longitudinal axis of the drilling direction at a rate less than that of the drill bit.

The above U.S. patent of Smith discloses a technique of steering the drilling tool to vary the azimuth of the curved bore section by providing an orientation device as a part of the drilling tool. The drilling tool thus comprises an upper part fixed relative to the drill tubing and a lower part including the drill bit and the bend section. A control motor system is provided by which the lower section can be rotated relative to the upper section in indexed steps of controlled predetermined amounts in response to motive force provided from the surface in the form of pulses in the drilling fluid.

A similar arrangement is disclosed in U.S. Pat. No. 5,311,952 of Eddison et al which uses an indexing device that is actuated by mud pulses but this in addition states that the reactive torque from the drill bit assists in effecting the rotation in the indexing direction.

These arrangement are generally satisfactory and have achieved some success but are relatively complex involving signalling from the surface and relatively complex mechanical structures in the drilling tool. It is also necessary to halt the drilling action and to lift the weight off the drill bit during the indexing step and therefore it is not possible to use this technique for slowly rotating the drilling tool while the drilling continues.

More recently designs of slowly rotating down-hole motors are currently being proposed which can also be commanded from the surface to start and stop to control changes in direction. However these have the disadvantages that it is difficult to convey power from the surface and also it is difficult to provide enough torque to turn the complete tool while drilling without putting too much torque on the coiled tubing, as this is susceptible to damage if over torqued.

It has also been proposed to steer the drilling tool by rotating the injector about the axis of the drill string. This acts to rotate the tubing which in turn rotates the drilling tool to the required angle.

In U.S. Pat. No. 5,485,889 of the present inventor issued Jan. 23$^{rd}$ 1996 is disclosed a drilling system for controlling steering of a downhole drilling tool which includes a shallow bend in the drilling tool and a system for rotating the bent drilling tool slowly about a longitudinal axis of the drilling tool while the drill bit rotates more rapidly. The system further allows the slow rotation to be halted at a predetermined orientation of the bend axis so as to effect a change in drilling direction. The system for rotating and halting this slow rotation comprises a downhole swivel coupling between the drilling tool and the drill string so that torque from the drill bit tends to rotate the drilling tool in the opposite direction. A control device in the form of a hydraulic pump is provided to restrict the amount of torque communicated through the swivel coupling and to halt the swivel coupling as required to control the steering of the drill bit. The patent also mentions in passing that a disk brake could also be used in replacement for the pump with the disk brake being actuated for example by a system similar to an anti-lock braking system of an automobile so that the coupling is allowed to rotate at a controlled rate. However the pump arrangement shown has a number of disadvantages in that it is not practical in a high pressure sanitary environment and it is difficult to provide an arrangement which will allow the passage of the required drilling fluid and electrical connections.

SUMMARY OF THE INVENTION

It is one object of the present invention to provide an improved apparatus for controlling the relative rotation of the parts which is suitable for use in a high pressure container for a sanitary environment and which will also allow drilling fluid and an electric line to pass through the center of the parts. The present invention can be used in other aspects of drilling for controlling the relative rotation of drill string parts and can also be used in other fields where the same problems arise.

According to a first aspect of the invention there is provided an apparatus for controlling rotation comprising: a first member and a second member mounted for rotation of one member relative to the other about an axis of rotation; a hydraulic pump having a first pump part mounted on the first member and a pump second part mounted on the second member and arranged such that the relative rotation of the members causes relative rotation of the first and second pump parts and thereby pumping of a hydraulic fluid from a first chamber to a second chamber within which the hydraulic fluid is under pressure; a hydraulically actuated brake having a first brake part on the first member and a second brake part on the second member and arranged such that application of the hydraulic fluid under pressure from the second chamber causes actuation of the brake to resist the relative rotation of the first and second members; a duct for releasing the hydraulic fluid under pressure from the second chamber for return to the first chamber for pumping by the pump arranged such that flow of the hydraulic fluid from the second chamber tends to release the brake to allow the relative rotation while said relative rotation causes pumping of further fluid to the second chamber to apply said brake; and an orifice for controlling flow of fluid through the duct to maintain the flow of fluid at a required rate to maintain the relative rotation at a required rate.

Preferably the first member comprises an outer sleeve surrounding an outer surface of the second member and rotatable about an axis longitudinal of the sleeve, the first and second members defining a generally cylindrical space therebetween and wherein the brake and the pump are located in the cylindrical space.

Preferably the second inner member is cylindrical so as to define an inner longitudinal channel therein for communication of fluid and/or electrical components therealong for use in controlling and effecting the drilling action.

Preferably the pump is generally annular surrounding the second inner member.

Preferably the pump includes a plurality of pumping cylinders at angularly spaced positions around the second inner member.

Preferably the pumping cylinders are actuated by an annular swash plate.

Preferably the brake comprises a plurality of annular brake disks surrounding the second inner member.

Preferably the brake comprises a plurality of axially spaced annular brake disks.

Preferably there is provided a control device for varying a size of the orifice so as to vary the flow of fluid from the second chamber.

Preferably the first and second chambers are annular surrounding the second inner member.

Preferably the pump includes a plurality of pumping cylinders each containing a movable piston therein with a spring acting to provide a spring return force on the piston whereby the pump provides a resistance to the relative rotation.

According to a second aspect of the invention there is provided an apparatus for controlling rotation comprising: a first outer sleeve member; a second inner cylindrical member having an inner longitudinal channel therein for communication of fluid therealong; the outer sleeve member surrounding an outer surface of the second inner member so as to define a generally cylindrical space therebetween; the first and second members being mounted for rotation of one member relative to the other about an axis of rotation longitudinal of the members; a generally annular hydraulic pump surrounding the second inner member in the cylindrical space and having a first pump part mounted on the first member and a pump second part mounted on the second member and arranged such that the relative rotation of the members causes relative rotation of said first and second pump parts and thereby pumping of a hydraulic fluid from a first chamber to a second chamber within which the hydraulic fluid is under pressure; a duct for releasing the hydraulic fluid under pressure from the second chamber for return to the first chamber for pumping by the pump; and an orifice for controlling flow of fluid through the duct to maintain said flow of fluid at a required rate to maintain the relative rotation at a required rate.

According to a third aspect of the invention there is provided an apparatus for controlling rotation comprising: a first member and a second member mounted for rotation of one member relative to the other about an axis of rotation; a hydraulic pump having a first pump part mounted on the first member and a pump second part mounted on the second member and arranged such that the relative rotation of the members causes relative rotation of the first and second pump parts and thereby pumping of a hydraulic fluid from a first chamber to a second chamber within which the hydraulic fluid is under pressure; a duct for releasing the hydraulic fluid under pressure from the second chamber for return to the first chamber for pumping by the pump; and an orifice for controlling flow of fluid through the duct to maintain the flow of fluid at a required rate to maintain the relative rotation at a required rate; wherein the pump includes a plurality of pumping cylinders each containing a movable piston therein with a spring acting to provide a spring return force on the piston whereby the pump provides a resistance to the relative rotation.

According to a fourth aspect of the invention there is provided an apparatus for controlling rotation comprising: a first member and a second member mounted for rotation of one member relative to the other about an axis of rotation; a hydraulically actuated brake having a first brake part on the first member and a second brake part on the second member and arranged such that application of the hydraulic fluid under pressure from a supply chamber causes actuation of the brake to resist the relative rotation of the first and second members; a duct for releasing the hydraulic fluid under pressure from the supply chamber arranged such that flow of the hydraulic fluid from the supply chamber tends to release the brake to allow the relative rotation; and a variable orifice actuable to control flow of fluid through the duct to maintain the flow of fluid at a required rate to maintain the relative rotation at a required rate.

One embodiment of the invention will now be described in conjunction with the accompanying drawings in which:

BRIEF DESCRIPTION OF THE DRAWINGS

In the drawings like characters of reference indicate corresponding parts in the different figures.

DETAILED DESCRIPTION

Figure 1:
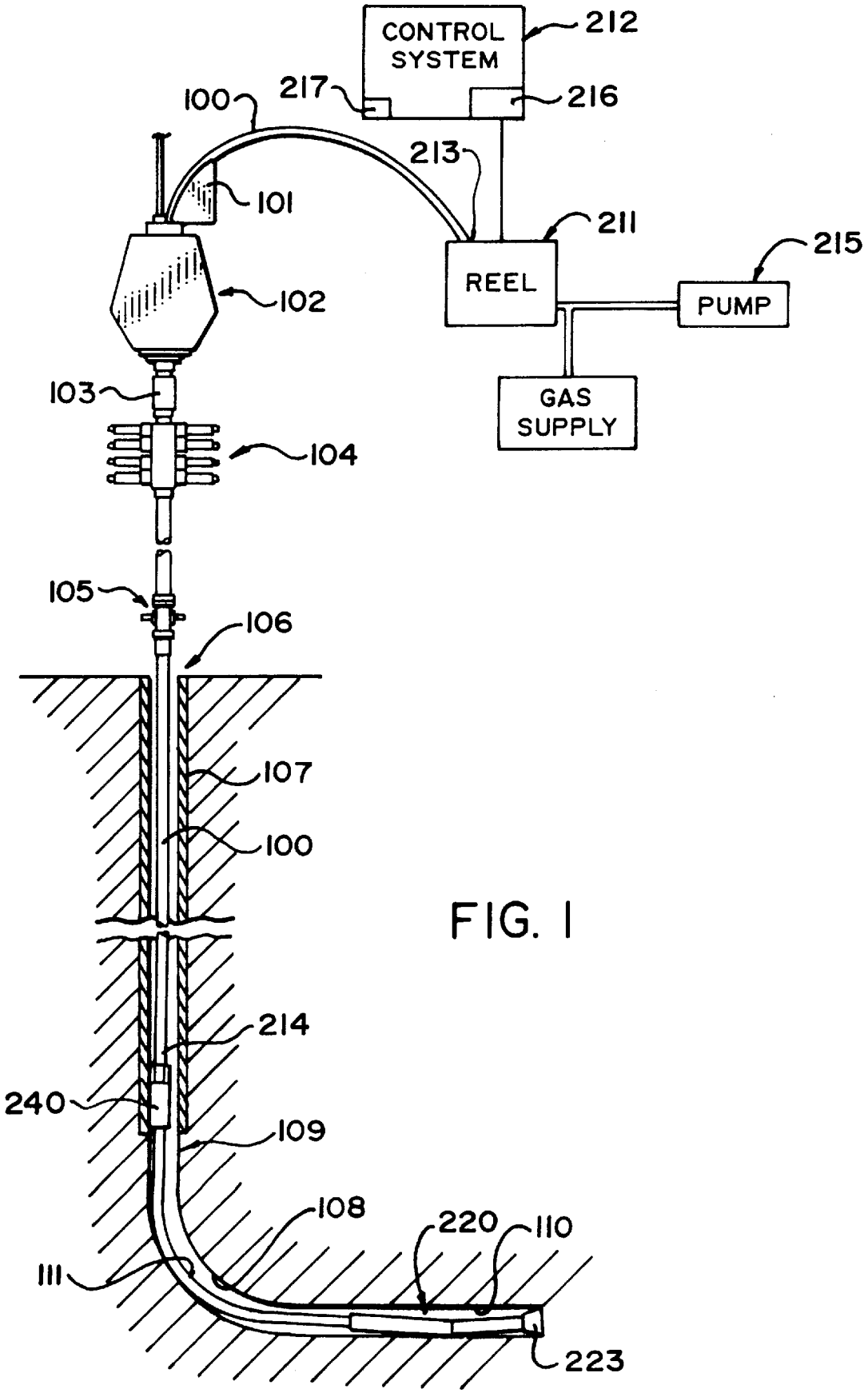
FIG. 1 is a schematic side elevational view of a drilling system including the ground level control system and the downhole drilling tool.

The arrangement of the present invention is based on my above U.S. Pat. No. 5,265,687, the disclosure of which is incorporated herein by reference. In particular the down hole drilling tool as shown schematically in FIG. 1 is taken from the disclosure of the above patent. In addition FIG. 1 also includes the above ground construction which is shown schematically for completeness. The same FIG. 1 is also used in my prior U.S. Pat. No. 5,485,889 which discloses a prior proposal for an apparatus for controlling the relative rotation of the parts of the drill string.

The apparatus therefore includes a drill tubing which as shown can comprise coiled tubing 100 supplied from a reel (not shown) over a guide arch 101. From the arch 101, the tubing enters an injector schematically indicated at 102 which is again of a conventional nature and acts to grasp the tubing using blocks which frictionally engage the tubing and force the tubing longitudinally both in the downward or the upward direction for feeding and withdrawing the tubing into the well bore. The construction of the injector is well known and this also acts to hold the tubing against rotation in a twisting direction so that the tubing is fed directly longitudinal without any twisting about its axis. In one known arrangement of the injector the tubing is grasped by opposed blocks, each of which has a front face of semi-cylindrical shape so that together the blocks form the majority of a cylinder surrounding the tubing. A plurality of the blocks are then mounted in two rows carried on a pair of opposed chains and movable thereby longitudinally of the well bore. The blocks are biased into engagement with the tubing by guide plates.

From the injector, the tubing passes into the well bore through a stripper 103, a blow out protector (BOP) 104 and a lubricator 105 to the well head 106. The stripper, BOP and lubricator are of a well known and conventional nature and are therefore shown only schematically and will not be described in detail herein. In an arrangement wherein the well bore is an existing producing well in which it is required to drill an extra horizontal section to increase production, the well includes an existing casing 107 in a substantially vertical portion of the well at the well head 106.

My U.S. Pat. No. 5,265,687 describes the technique for drilling the short radius curved section 108 at or adjacent a bottom end 109 of the vertical portion. The present invention is particularly concerned with a method for controlling the drilling of a horizontal straight section 110 of the well bore at the remote end of the curved portion 108.

The system at ground level includes a reel 211 for the coiled tubing 100 so that the coil tubing has an upper end 213 attached to the reel and a lower end 214 attached to the drilling tool generally indicated at 220. A drilling fluid pump 215 supplies drilling fluid into the upper end 213 of the coil tubing at the reel for transmitting the drilling fluid through the coil tubing to the down hole drilling tool 220. In addition at the ground level there is provided a control system 212 which includes a display 216 for receiving information from downhole transducers and a control system including a valve control 217 for supplying downhole control data to the drilling tool.

Figure 2:
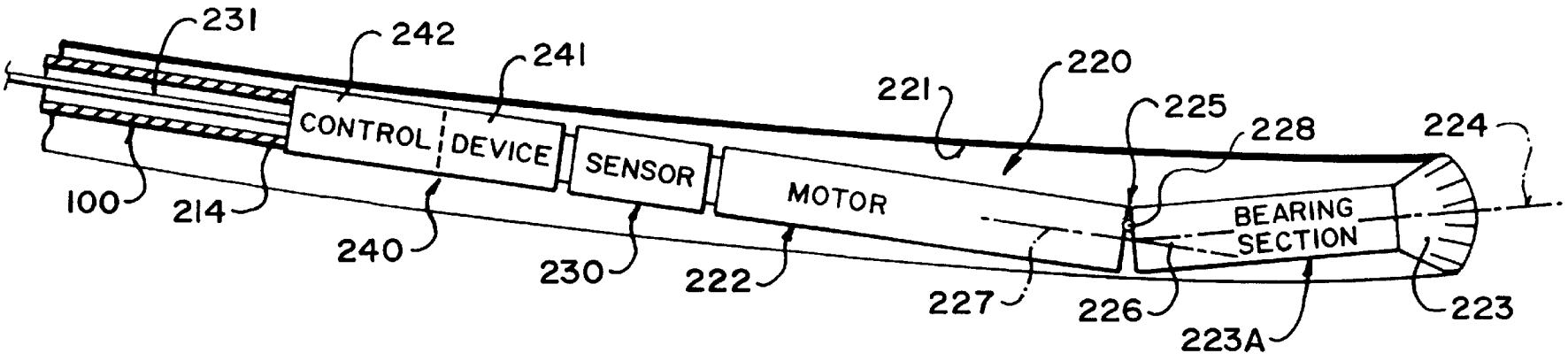
FIG. 2 is a side elevational view of the down hole drilling tool only of a system similar to that of FIG. 1 in which the control device is arranged immediately adjacent the tool body.

The downhole drilling tool 220 is shown in larger scale in FIG. 2 and includes a conventional motor 222 which is preferably of the type driven by the flowing drilling fluid for generating a rotational movement which is communicated to the drill bit 223 for rotation of the drill bit in a bearing section 223A about a longitudinal axis 224 of the drill bit. In the arrangement shown, the motor is attached to the bearing section of the drill bit by a knuckle 225 which provides a shallow bend angle 226 between a longitudinal axis 227 of the motor and the longitudinal axis 224 of the drill bit. This bend angle is obtained by cranking the drill bit about a transverse axis 228 at right angles to the longitudinal axis 224 and 227. In the position shown, therefore, the drill bit will have a tendency to drill upwardly that is in a direction generally at right angles to the transverse bend axis 228 and on the side of the longitudinal axis 224 opposite to the angle 226.

It is well known that a bent drilling tool of this type can be used to drill horizontal bore holes 221 by slowly rotating the drilling tool including the motor and the drill bit about the longitudinal axis of the drill bit so that the axis 228 gradually rotates about the axis 224. This gradual rotation of a bent drilling tool provides more accurate control over the horizontal orientation than would simply providing a straight drilling tool and maintain that straight drilling tool in the fixed horizontal orientation.

It is further known, in the event that the drilling tool deviates from the required direction, the direction of drilling can be controlled by halting the slow rotation of the drilling tool about the axis 224 and holding the bend axis 228 at a required orientation so as to direct the drill bit in the required direction to overcome the inaccuracy in the drilling. In this way the bend axis 228 can be maintained stationary for sufficient period of time to regain the required direction of drilling. A sensor unit is schematically indicated at 230 which is used to detect the orientation of the drilling tool during drilling to detect and control deviations from the required direction drilling.

The sensor 230 is of conventional construction and accordingly shown only schematically. The sensor 230 communicates through a communication system 231 shown schematically as a cable passing through the coiled tubing for communicating information to the display 216.

It is further well known and readily apparent that the rotation of the drill bit in engagement with a drill face of the hole to be drilled generates torque in the drilling tool tending to twist the coiled tubing. This torque must be resisted by the coil tubing in order to generate the rotation of the drill bit relative to the drill face.

The present invention is directed to an apparatus for controlling the motive force for effecting the relatively slow rotation of the drilling tool about the longitudinal axis of the drill bit. The present invention, therefore, is related to the additional control device schematically indicated at 240 which is located between the drilling tool 220 and the coiled tubing 100.

In FIG. 1, the control device 140 is located at or adjacent the lower end of the vertical portion of the well and is connected to the drilling tool body by a length of tubing 111 which extends through the lowermost part of the vertical portion and through the curved portion to the required position of the horizontal section. The length of the tubing 111 is selected so that the control device remains in the vertical portion within the casing 107 while the tool moves to drill the curved portion and the required length of the horizontal section.

In FIG. 2, the arrangement is modified so that the control device is located immediately at or adjacent the drilling tool.

Figure 3B:
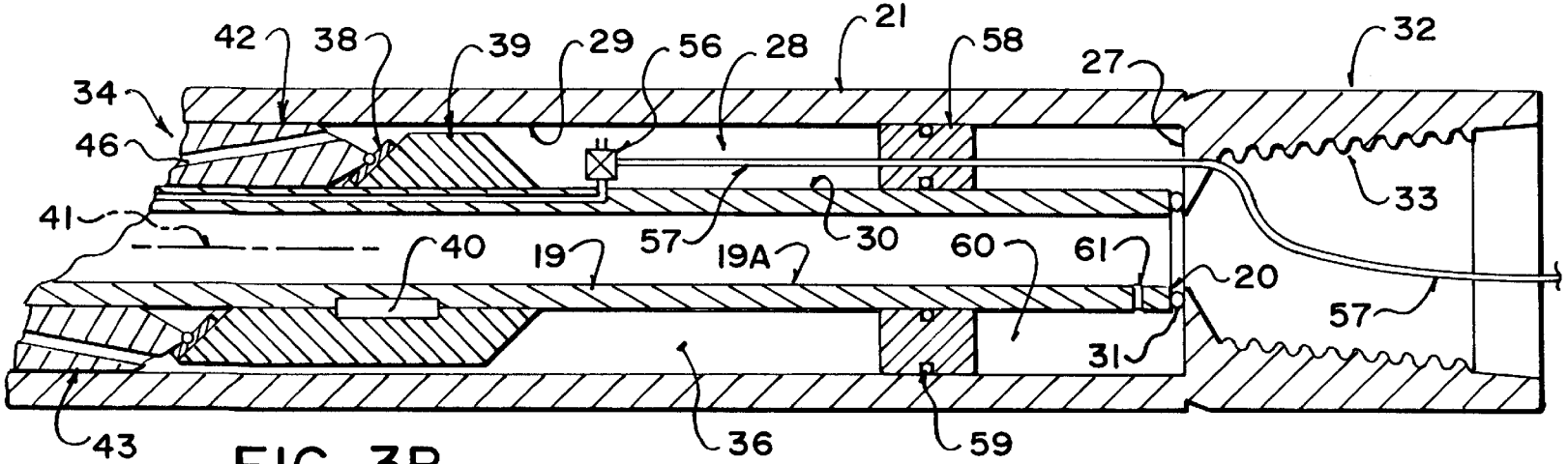
FIG. 3 which is divided into two parts 3A and 3B for convenience is a cross sectional view through the control device of FIG. 1 or FIG. 2.
Figure 3A:
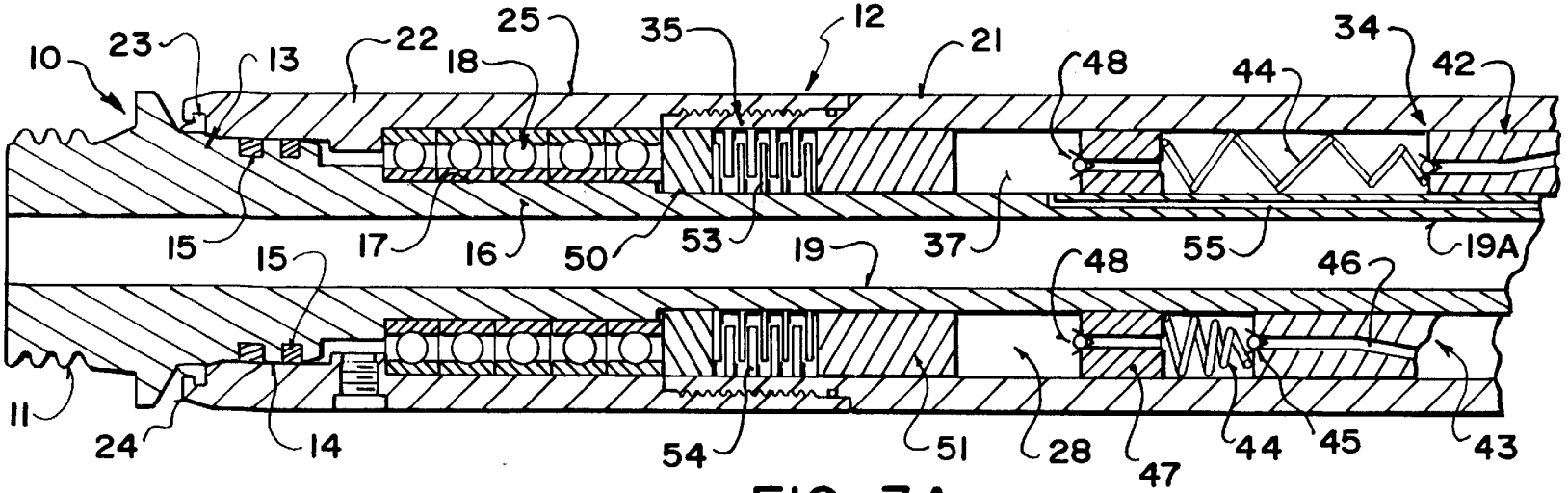

The details of the control device are shown in FIGS. 3A and 3B wherein the control unit comprises a sub for attachment into the drill string and comprises a first member 10 having a threaded end 11 for attachment to the drill string on the side adjacent the drill bit and a second member 12 which is rotatable relative to the first member.

The first member 10 comprises a collar portion 13 at the threaded end 11 which is rigidly attached to or integral with the threaded end 11. The collar defines an outer cylindrical surface 14 carrying a pair of seals 15 for co-operation with an inner surface of the second member 12. The collar connects to a bearing support portion 16 having an outer surface 17 carrying a plurality of bearings 18 at axially spaced positions along the length of the surface 17. Attached to the bearing portion 16 is an elongate cylindrical tube 19 which extends from the bearing portion 16 to a remote end 20. The tube portion 19 has an inner surface 21 which defines a duct through the sub for communication of drilling fluid and electrical and other control lines.

The outer member 12 defines a sleeve 21 which surrounds the outer surface of the inner member. The sleeve 21 has a first portion 22 adjacent the seals 14 and co-operating therewith to define a seal preventing the penetration of drilling fluid into the area between the inner member 10 and the outer member 12. An additional lip seal 23 is located at the remote end 24 of the outer member.

The outer member further includes a second portion 25 adjacent to and co-operating with the bearing section 16 and carrying an outer race of the bearings 18 to provide free rotation between the inner and outer members.

At the opposite end the outer member sleeve 21 has an inwardly projecting portion 26 which defines an end face 27 of an annular chamber 28. The chamber 28 is defined between an inside surface 29 of the outer member and an outside surface 30 of the tubular portion 19 of the inner member. The shoulder 27 co-operates with the seal 31 located between the end 20 of the inner member and the shoulder.

The outer member 12 includes a female collar 32 outwardly of the shoulder 27 and having a threaded section 33 for connection to the next sub. The collar defines a hollow interior so that fluid and connection lines from the next sub can connect through the collar into the tubular duct defined by the inner surface 21.

Inside the annular chamber 28 is provided a pump generally indicated at 34 and a brake generally indicated at 35. The pump 34 is arranged to pump fluid from a first chamber 36 to a second chamber 37. The pump 34 is of the swash-plate type having a swash-plate 38 carried on a support member 39 attached to the inner tubular portion 19 by key 40. The swash-plate is thus arranged in a plane at an angle to the longitudinal axis 41 of the sub and rotates with the inner tubular portion 19 about the axis 41.

The pump further includes a plurality of angularly spaced pistons two of which are visible in the cross-section at 42 and 43. It will, however, be appreciated that there are a plurality of pistons around the axis 41 with each piston being movable independently of the others when pushed by the swash-plate so that the pistons move backwards and forwards within the respective cylinders against the bias of a respective spring 44. Each piston carries a one-way check valve 45 within a duct 46 through the piston.

The rear end of the spring 44 sits against a fixed cylinder block 47 defining one end of the chamber 37. The cylinder block 47 carries a one-way check valve 48. It will be appreciated therefore that the reciprocated action effected on the pistons by the swash-plate causes fluid to be drawn from the chamber 36 and passed through the ducts 46 via the valves 45 and 48 into the chamber 37. The rate of pumping of the fluid is directly proportional to the rate of rotation. The pistons and the cylinder block are mounted on the outer member so that the swash-plate rotates relative to the piston.

The brake 35 comprises an annular end block 50 which is fixed at one end of the bearing section. The brake further includes an annular or donut shaped piston 51 surrounding the inner tubular member. Alternatively a plurality of actuating pistons can be used arranged at angularly spaced positions around the inner tubular member 19. In between the annular piston 51 and the block 50 is provided the plurality of annular brake disks 53 and 54. The disks 53 are attached to the inner tubular member 19. The disks 54 are attached to the outer sleeve 21. The pressure from the piston 51 applies longitudinal force on the brake disks so as to provide frictional engagement between the brake disks and to supply braking torque at a value proportional to the pressure in the chamber 37 pushing on the piston 51

A vent duct 55 communicates from the second chamber 37 into the first chamber 28 through a variable orifice 56. The variable orifice or valve is controlled by an electrical control line 57 from a suitable control system. Thus fluid continually bleeds back from the chamber 37 to the chamber 36 at a rate dependant upon the orifice 56.

A floating baffle or annular piston 58 separates the chamber 36 from the shoulder 27. The baffle 58 carries a seal 59 which separates the chamber 36 from a further chamber 60 adjacent the shoulder 27. A vent opening 61 communicates drilling fluid from the duct 46 into the chamber 60 so as to keep the chamber 36 and the fluid therein under pressure.

In operation, relative rotation between the inner and outer parts caused by the torque between the drill bit attached to the male end of 11 and the drill string attached to the female end at 33 causes pumping action of the pump 34 to communicate fluid from the chamber 36 into the chamber 37 under pressure. The fluid in the chamber 37 activates the brake disks so as to resist the relative rotation. Also the pump itself resists the rotation due to the torque required to drive the pump in part generated by the springs 44. In the event that the orifice 56 is closed, no fluid bleeds out of the chamber 37 so that the brake is fully pressurized halting the relative rotation. In the event that the orifice 56 in open, some fluid bleeds back from the chamber 37 thus reducing the pressure in the chamber 37 and allowing the brake to be released. The balance therefore between the relative rotation, the torque and the pump, the braking effect and pumping of the fluid maintains relative rotation at a constant rate variable by operating the variable orifice 56.

The system allows the drilling fluid and control ducts to pass through the duct 46. The hydraulic fluid, the pump and the brake are all maintained separate from the drilling fluid in a hygienic condition.

The rotation of the drilling tool is therefore obtained by extracting from the normal rotation of the drill bit a smaller portion of the torque to provide a motive force for the counter-rotation. There is no necessity therefore for any supply of additional motive force from the surface, from battery power or the like. Furthermore, the absorption of some of the torque to the drill bit in the counter-rotation reduces the torque on the drill string. With the drill string designed and manufactured to accommodate the maximum torque which can be generated by the motor, the drill string can certainly accommodate the reduced torque which is obtained as a portion of that torque is communicated through the junction of the control device 40. There is little or no possibility therefore of over torquing the drill string thus avoiding the potential for damage which can be effected by conventional downhole drive motors.

As the rotation of the drilling tool is obtained as a counter-rotation generated wholly by the torque from the drill bit, there is no necessity for any pulses to be supplied from the ground surface to control an indexing device. The mud pressure can therefore be maintained constant and the mud flow rate also remains constant so the drilling continues at a constant rate and at a constant torque on the drill bit. In addition the rotation of the drilling tool is at a constant rate which provides the required proper control of the drilling direction by smoothly rotating the drilling tool at the constant rate as previously described.

Since various modifications can be made in my invention as herein above described, and many apparently widely different embodiments of same made within the spirit and scope of the claims without departing from such spirit and scope, it is intended that all matter contained in the accompanying specification shall be interpreted as illustrative only and not in a limiting sense.

What is claimed is:

1. Apparatus for drilling a well bore comprising:

a drilling tool and a drill tubing mounted for rotation of the drilling tool relative to the drill tubing about an axis of rotation;

the drilling tool including a main tool body and a rotary drill bit mounted on the main body for rotation relative to the main body such that rotation of the drill bit causes a torque to be developed between the main body of the drilling tool and the drill tubing;

and an apparatus for controlling rotation of the main body of the drilling tool relative to the drill tubing in response to said torque comprising:

a hydraulic pump having a first pump part a first member connected to one of the drilling tool and the drill tubing and a pump second part a second member connected to the other of the drilling tool and the drill tubing and arranged such that said relative rotation of the drilling tool and the drill tubing causes relative rotation of said first and second pump parts and thereby pumping of a hydraulic fluid from a first chamber to a second chamber within which the hydraulic fluid is under pressure;

a hydraulically actuated brake having a first brake part on the first member and a second brake part on the second member and arranged such that application of the hydraulic fluid under pressure from the second chamber causes actuation of the brake to resist said relative rotation of the drilling tool and the drill tubing;

a duct for releasing the hydraulic fluid under pressure from the second chamber for return to the first chamber for pumping by the pump arranged such that flow of the hydraulic fluid from the second chamber tends to release the brake to allow said relative rotation while said relative rotation causes pumping of further fluid to the second chamber to apply said brake;

and an orifice for controlling flow of fluid through the duct, the orifice being operable to maintain said flow of fluid at a required rate to maintain the relative rotation at a required rate.

2. The apparatus according to claim 1 wherein the first member comprises an outer sleeve surrounding an outer surface of the second member and rotatable about an axis longitudinal of the second member, the first and second members defining a generally cylindrical space therebetween and wherein the brake and the pump are located in the cylindrical space.

3. The apparatus according to claim 2 wherein the pump is generally annular surrounding the second member.

4. The apparatus according to claim 3 wherein the pump includes a plurality of pumping cylinders at angularly spaced positions around the second member.

5. The apparatus according to claim 4 wherein the pumping cylinders are actuated by an annular swash plate in the cylindrical space.

6. The apparatus according to claim 2 wherein the brake comprises a plurality of annular brake disks surrounding the second member.

7. The apparatus according to claim 6 wherein the brake comprises a plurality of axially spaced annular brake disks in the cylindrical space.

8. The apparatus according to claim 2 wherein the second member is cylindrical so as to define an inner longitudinal channel therein for communication of fluid therealong.

9. The apparatus according to claim 2 wherein the first and second chambers are annular surrounding the second member.

10. The apparatus according to claim 1 wherein there is provided a control device for varying a size of the orifice so as to vary the flow of fluid through the duct from the second chamber.

11. The apparatus according to claim 1 wherein the pump includes a plurality of pumping cylinders each containing a movable piston therein with a spring acting to provide a spring return force on the piston whereby the pumping cylinders of the pump provide a resistance to said relative rotation.

12. Apparatus for controlling rotation comprising:

a first outer sleeve member;

a second inner cylindrical member having an inner longitudinal channel therein for communication of fluid therealong;

the outer sleeve member surrounding an outer surface of the second inner member so as to define a generally cylindrical space therebetween;

the first and second members being mounted for rotation of one member relative to the other about an axis of rotation longitudinal of the members;

a generally annular hydraulic pump surrounding the second inner member in the cylindrical space and having a first pump part mounted on the first member and a pump second part mounted on the second member and arranged such that said relative rotation of the members causes relative rotation of said first and second pump parts and thereby pumping of a hydraulic fluid from a first chamber to a second chamber within which the hydraulic fluid is under pressure;

a duct for releasing the hydraulic fluid under pressure from the second chamber for return to the first chamber for pumping by the pump;

and an orifice for controlling flow of fluid through the duct, the orifice being operable to maintain said flow of fluid at a required rate to maintain the relative rotation at a required rate.

13. The apparatus according to claim 12 wherein the pump includes a plurality of pumping cylinders at angularly spaced positions around the second inner member.

14. The apparatus according to claim 13 wherein the pumping cylinders are actuated by an annular swash plate.

15. The apparatus according to claim 12 wherein there is provided a control device for varying a size of the orifice so as to vary the flow of fluid from the second chamber.

16. The apparatus according to claim 12 wherein the first and second chambers are annular surrounding the second inner member.

17. The apparatus according to claim 12 wherein the pump includes a plurality of pumping cylinders each containing a movable piston therein with a spring acting to provide a spring return force on the piston whereby the pump provides a resistance to said relative rotation.

18. Apparatus for drilling a well bore comprising:

a drilling tool and a drill tubing mounted for rotation of the drilling tool relative to the drill tubing about an axis of rotation;

the drilling tool including a main tool body and a rotary drill bit mounted on the main body for rotation relative to the main body such that rotation of the drill bit causes a torque to be developed between the main body of the drilling tool and the drill tubing;

and an apparatus for controlling rotation according to claim 12 wherein the main body of the drilling tool is connected to one of the first and second members and the drill tubing is connected to the other of the first and second members.

19. Apparatus for controlling rotation comprising:

a first member and a second member mounted for rotation of one member relative to the other about an axis of rotation;

a hydraulic pump having a first pump part mounted on the first member and a pump second part mounted on the second member and arranged such that said relative rotation of the members causes relative rotation of said first and second pump parts and thereby pumping of a hydraulic fluid from a first chamber to a second chamber within which the hydraulic fluid is under pressure;

a duct for releasing the hydraulic fluid under pressure from the second chamber for return to the first chamber for pumping by the pump;

and an orifice for controlling flow of fluid through the duct to maintain said flow of fluid at a required rate to maintain the relative rotation at a required rate;

wherein the pump includes a plurality of pumping cylinders each containing a movable piston therein with a spring acting to provide a spring return force on the piston whereby the pump provides a resistance to said relative rotation.

20. The apparatus according to claim 19 wherein the pumping cylinders are actuated by an annular swash plate.

21. Apparatus for drilling a well bore comprising:

a drilling tool and a drill tubing mounted for rotation of the drilling tool relative to the drill tubing about an axis of rotation;

the drilling tool including a main tool body and a rotary drill bit mounted on the main body for rotation relative to the main body such that rotation of the drill bit causes a torque to be developed between the main body of the drilling tool and the drill tubing;

and an apparatus for controlling rotation according to claim 19 wherein the main body of the drilling tool is connected to one of the first and second members and the drill tubing is connected to the other of the first and second members.

* * * * *